US005463413A

United States Patent [19]

Ho et al.

[11] Patent Number: 5,463,413

[45] Date of Patent: Oct. 31, 1995

[54] INTERNAL SUPPORT FOR TOP-SHOOTER THERMAL INK-JET PRINTHEAD

[75] Inventors: May F. Ho, La Mesa, Calif.; Ellen Tappon, Corvalis, Oreg.

[73] Assignee: Hewlett-Packard Company, Palo Alto, Calif.

[21] Appl. No.: 72,298

[22] Filed: Jun. 3, 1993

[51] Int. Cl.[6] ..... B41J 2/175; B41J 2/05

[52] U.S. Cl. ..... 347/65; 347/93

[58] Field of Search ..... 347/63, 65, 93

[56] References Cited

U.S. PATENT DOCUMENTS

| | | | |
|---|---|---|---|
| 4,380,770 | 4/1983 | Maruyama | 347/89 |
| 4,394,670 | 7/1983 | Sugitani | 347/65 |
| 4,490,728 | 12/1984 | Vaught | 347/56 |
| 4,639,748 | 1/1987 | Drake | 347/93 |
| 4,683,481 | 7/1987 | Johnson | 347/65 |
| 4,698,645 | 10/1987 | Inamoto | 347/65 |
| 4,875,059 | 10/1989 | Masuda | 347/93 |
| 4,882,595 | 11/1989 | Trueba | 347/65 |

FOREIGN PATENT DOCUMENTS

| | | | |
|---|---|---|---|
| 314486 | 5/1989 | European Pat. Off. | B41J 3/04 |

*Primary Examiner*—Joseph W. Hartary

[57] ABSTRACT

A "barrier reef" configuration, comprising a plurality of cays, or pillars, is provided, each pillar associated with the entrance to a firing chamber in a thermal ink-jet printhead. Each firing chamber is formed in a photopolymer layer, together with an associated barrier inlet channel that fluidically communicates with a common ink refill channel which acts as a common reservoir to the each firing chamber, in which resides a resistor element. When energized, the resistor element fires a droplet of ink toward a print medium. Over each resistor element is a nozzle, formed in an orifice plate, for firing the droplets of ink orthogonal to the resistor element. The pillars, which are positioned near the ink refill channel, serve to support the orifice plate and act as pillars between the substrate and the orifice plate, thereby avoiding any pinching effect that would otherwise occur for an unsupported region. Advantageously, the pillars are spaced apart by an amount equal to the smallest dimension of the system and are placed as close as possible to a common ink feed channel so as to keep contaminant particles outside the firing chamber and in the common ink feed channel region.

15 Claims, 2 Drawing Sheets

INTERNAL SUPPORT FOR TOP-SHOOTER THERMAL INK-JET PRINTHEAD

TECHNICAL FIELD

The present invention relates to printheads employed in ink-jet printers, and, more particularly, to control of internal particle contamination.

BACKGROUND ART

Ink-jet pens comprise a reservoir of ink and a printhead comprising a plurality of orifices from which ink is expelled toward a print medium, such as paper. Between the reservoir of ink and the printhead are passages, including a plurality of firing chambers and a plenum for supplying ink to the firing chambers. Each firing chamber includes a resistive heating element, which is energized upon demand to fire a droplet, or bubble, of ink through the orifice associated with that resistor.

The orifices through which the ink is expelled in the printhead are on the order of 50 μm in diameter. The passages can be as small as widths of ~40 μm and heights of ~25 μm. Any particles larger than about 25 μm can become trapped at various locations within the pen in or near the firing chamber and cause clogging. Of course, smaller particles can also become trapped, depending on the aspect ratio of the particle. Such clogging, of course, interferes with the quality of the printed image.

Present ink-jet pens have a fine mesh filter to separate internal particle contamination from the bulk ink supply before the ink reaches the firing chambers. The mesh is sized to about 25 μm. However, as ink-jet technology is used to produce higher resolution printing, a smaller diameter jet, or orifice, is required. This is achieved by decreasing printhead nozzle diameter. As a result, an increase in the internal particle problem is anticipated. If this is true, then a finer mesh filter may be required, which in turn would require a larger filter area so as to minimize pressure drop across the filter. These changes would affect pen design, cost, and manufacturing strategy.

A solution to the problem of particle contamination is addressed by European Patent Application No. 92102748.8. A plurality of lands are provided, both near each entrance to a firing resistor and between the entrances.

However, a further problem exists in the construction of pens employing a ink feed channel acting as a common reservoir of ink. Namely, a nozzle plate, which contains the nozzles through which the ink is expelled, tends to sag in unsupported areas, including over the ink feed channel. Such pens are referred to as "top-shooter" or "roof-shooter" pens. The sagging nozzle plate can pinch off the supply of ink, thereby reducing the usefulness of the pen.

The above-mentioned European Patent Application is directed to the so-called "side-shooter" thermal ink-jet configuration, and this configuration does not have a common ink refill channel through the substrate on which the firing resistors are formed, but rather has a plurality of orifi through the top of a cover plate for introducing ink into a common area. There appears to be no problem with sag of the cover plate associated with the side-shooter configuration.

Accordingly, there remains a need to support the nozzle plate in the vicinity of the ink feed channel and to remove particle contamination from the ink in ink-jet pens.

DISCLOSURE OF INVENTION

In accordance with the invention, a "barrier reef" configuration, comprising a plurality of cays, or pillars, is provided, each pillar associated with the entrance to a firing chamber. The pillars are spaced apart by an amount less than or equal to the smallest dimension of the system, and are placed as close as possible to the common ink feed channel so as to support the orifice plate and keep particles outside the firing chamber. The smallest dimension of the system is likely to be either the nozzle size or the width of the passageway (the barrier inlet channel) connecting the source of ink to the firing chamber.

The pillars, being formed from the barrier material and hence the same height as the barrier material, act as support pillars between the substrate and the orifice plate, thereby avoiding any pinching effect that would otherwise occur for an unsupported region. Advantageously, spacing the pillars as indicated above prevents internal particle contamination that is trapped inside the ink-jet printhead during assembly from detrimentally affecting ink-jet formation and performance.

BEST MODES FOR CARRYING OUT THE INVENTION

Figure 1:
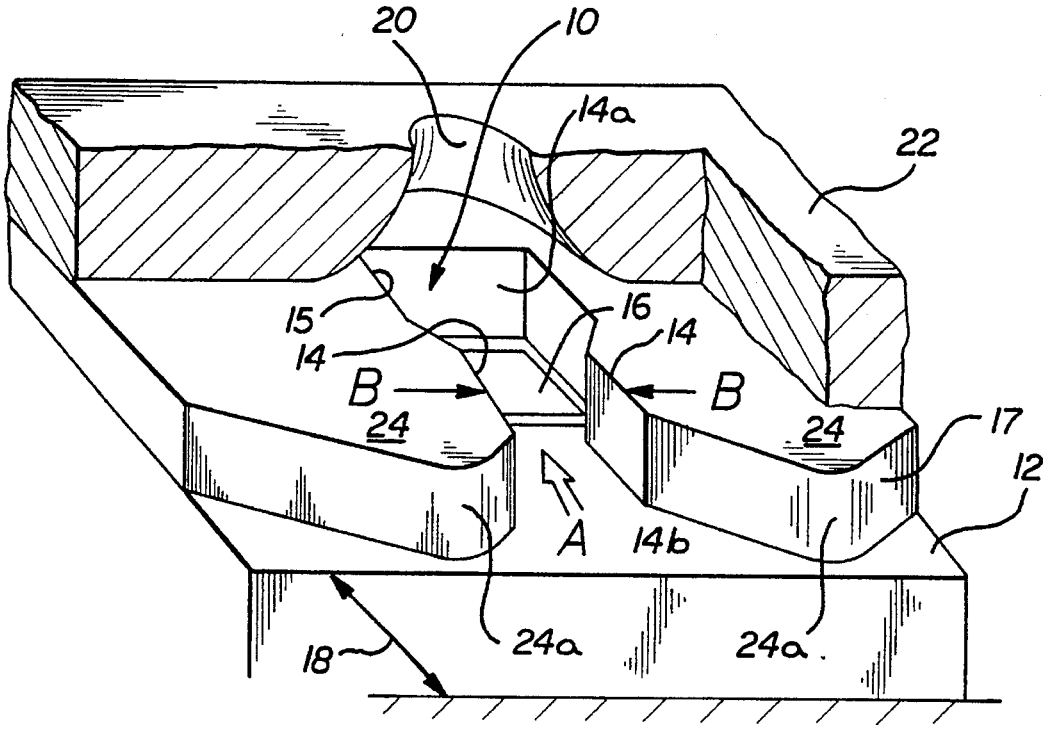
FIG. 1 PRIOR ART
FIG. 1 is a perspective view of a resistor and barrier inlet channel in relation to an ink feed channel, or plenum, of a prior art thermal ink-jet printhead design.

Referring now to the drawings where like numerals of reference denote like elements throughout, FIG. 1 depicts a printing or drop ejecting element 10, formed on a substrate 12. Each firing element 10 comprises a barrier inlet channel, or discrete ink passage, 14, with a resistor 16 situated at one end **14*a* thereof. The barrier inlet channel 14 and drop ejection chamber 15 encompassing the resistor 16 on three sides are formed in a layer 17 which comprises a photopolymerizable material which is appropriately masked and etched/developed to form the desired patterned opening. This material 17** is often referred to as a barrier layer.

Ink (not shown) is introduced at the opposite end **14*b* of the barrier inlet channel 14, as indicated by arrow "A", from an ink feed channel, or common liquid passage, indicated generally at 18. The ink feed channel 18 passes through the substrate 12** and is provided with a continuous supply of ink from an ink reservoir (not shown), located beneath the substrate.

Associated with each resistor 16 is a nozzle 20, located near the resistor in a nozzle plate 22. Droplets of ink are ejected through the nozzle (e.g., normal to the plane of the resistor 16) upon heating of a quantity of ink by the resistor. Each drop ejection chamber 15, the resistor 16 therein, and the associated nozzle 20 may be collectively referred to as an ejection outlet for ejecting ink.

A pair of opposed projections 24 at the entrance to the barrier inlet channel 14 define the channel width, as indicated by the arrow "B".

Each such printing element 10 comprises the various features set forth above. Each resistor 16 is seen to be set in a drop ejection chamber 15 defined by three barrier walls and a fourth side open to the ink feed channel 18 of ink common to at least some of the elements 10, with a plurality of nozzles 20 comprising orifices disposed in a cover plate 22 near the resistors 16. Each orifice 20 is thus seen to be operatively associated with a resistor 16 for ejecting a quantity of ink normal to the plane defined by that resistor and through the orifices toward a print medium (not shown) in defined patterns to form alphanumeric characters and graphics thereon.

Ink is supplied to each element 10 from the ink feed channel 18 by means of the barrier inlet channel 14. Each drop ejection chamber 15 is provided with a pair of opposed projections 24 formed in the walls of the barrier layer 17 at the entrance of the barrier inlet channel 14 and separated by a width "B" to define the channel width. Each firing element 10 may be provided with lead-in lobes **24*a* disposed between the projections 24 and separating one barrier inlet channel 14 from a neighboring barrier inlet channel 14'**.

In accordance with the invention, a "barrier reef" configuration, comprising a plurality of pillars 26, is provided. Each pillar 26 is associated with the entrance to a firing chamber 15 by placement between the barrier inlet channel 14 to that firing chamber and the ink feed channel 18.

The barrier reef design of the invention is achieved by modifying the barrier mask to add elliptical pillars 26 along the edge of the ink feed channel 18. That is, the pillars 26 are formed at the same time the barrier layer 17 is processed to form the barrier inlet channels 14, the firing chambers 15, and the like therein. Thus, the pillars 28 are the same height as the barrier layer 17. The major axis of the each pillar 26 is perpendicular to the ink flow from the ink feed channel 18 to the barrier inlet channel 14.

Figure 2:
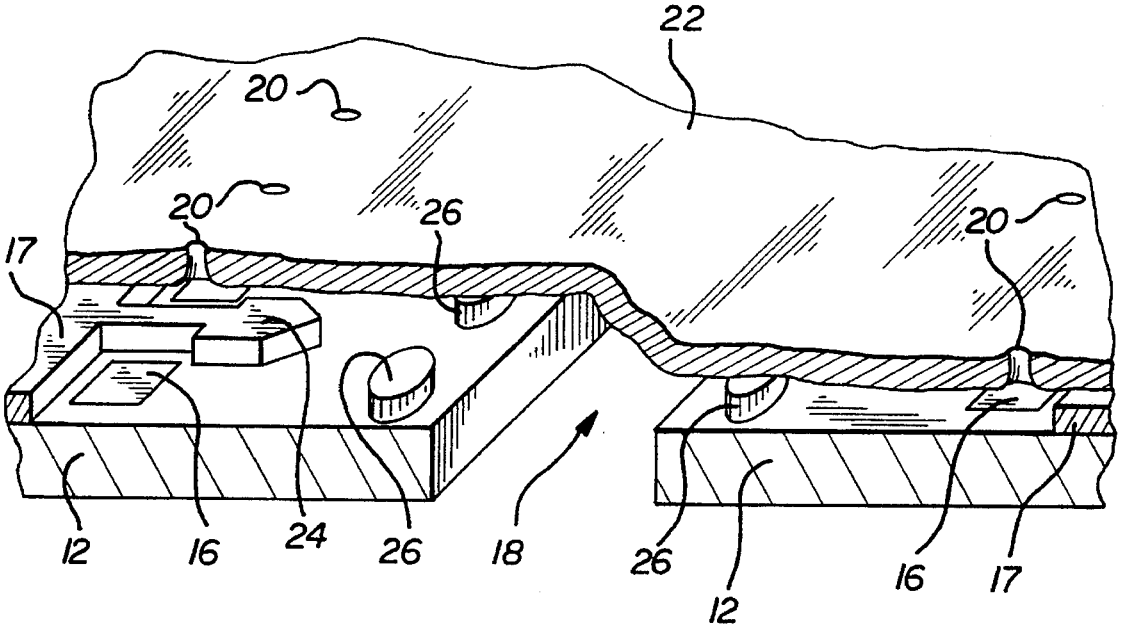
FIG. 2 is a perspective view of a barrier reef design in accordance with the invention.
Figure 3:
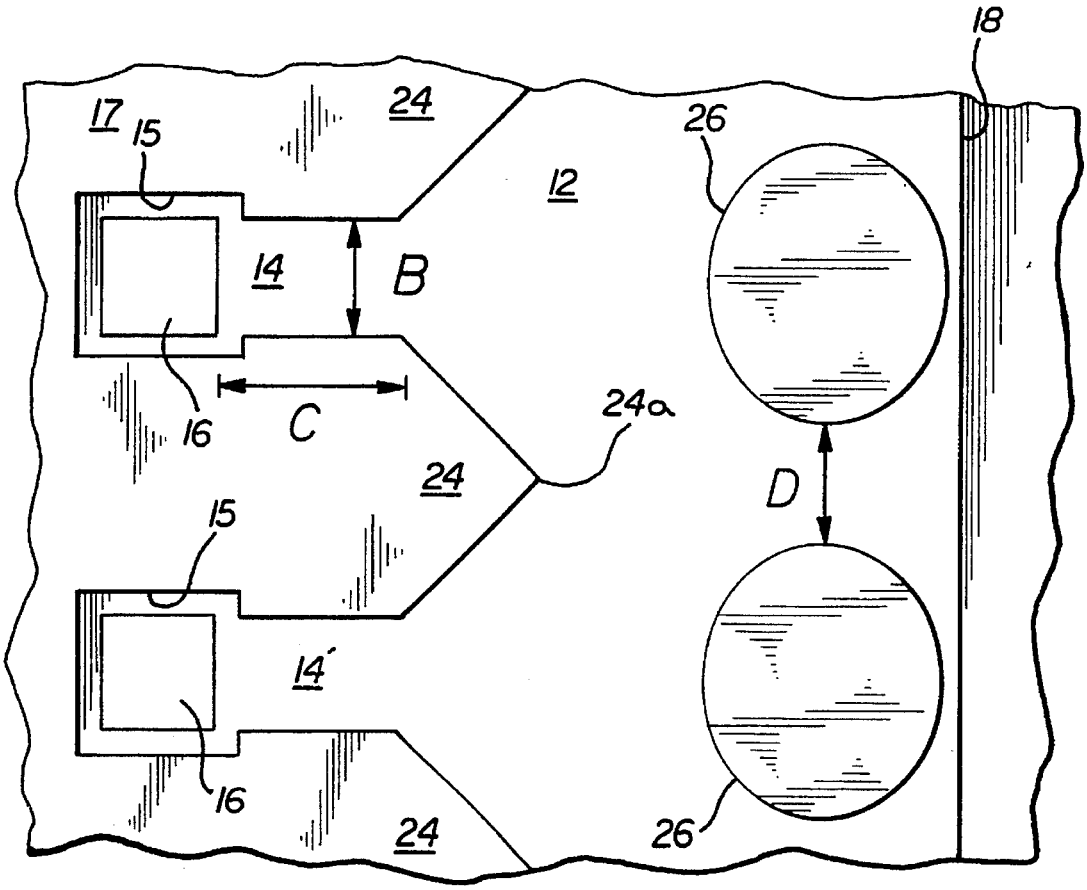
FIG. 3 is a top plan view of a portion of the barrier reef in association with the ink feed channel and barrier inlet channel, in accordance with the invention.

FIGS. 2 and 3 show the barrier reef configuration of the invention. The spacing between these pillars 26 is designed so as to provide support for orifice plate 22 in the vicinity of the ink feed channel be and 18 to filter out internal particles from ink before the particles reach the barrier inlet channel 14. Dust or other contamination particles will be caught by these pillars 26 at locations far enough from each individual nozzle 20 so as not to affect nozzle performance.

The main design goal is to optimize the size and spacing of the reef pillars:

1. to minimize ink flow resistance for refill of the drop ejection chamber 15;
2. to ensure good adhesion through the life of the pen; and
3. to minimize deflection of the orifice plate 22 over the ink feed channel be and 18 thereby avoid pinch-off of the ink in the otherwise unsupported region.

There is a tradeoff between the operational frequency and the ink flow. It is important to balance the dimension of the barrier inlet channel 14, the configuration of the barrier reef 26 (dimensions and spacing), and the distance between the resistor 16 and the ink feed channel 18 in order to maintain a high operating frequency, which requires rapid refill, consistent with damping during the refill to avoid fluid oscillation.

In order to accomplish this goal, the length C of the barrier inlet channel 14 is decreased, compared to the prior art design. This maintains the operating frequency to offset the increased fluid resistance due to the presence of the pillars 26. In this connection, for one particular design configuration, the value of the length of the barrier inlet channel 14 was reduced by about 15% from the prior art configuration. This correction was found to be effective so that there was no change in print quality on paper in comparison to the prior art configuration when printing at the required speed.

The minimum spacing D between each pillar 26 should be less than the minimum dimension of the system. Thus, from the above discussion, it is clear that the size of the orifice 20 is the dictating dimension. However, an alternative possible limiting dimension is the width B of the barrier inlet channel 14.

The dimension of each pillar 26 is related to the spacing between resistors 16 (resistor-to-resistor spacing, center-to-center) less the spacing between pillars. Essentially, the center of each pillar 26 is aligned with the center of each resistor 16.

An additional consideration includes the relationship of the size of the pillar 26 to the resistance to flow of the ink to the nozzle 20. Larger pillars 26 tend to increase the resistance to the flow of the ink, and thereby decrease the operating frequency of the device. As indicated above, the operating frequency is maintained at a desired high value by decreasing the fluid flow resistance between the resistor 16 and the ink feed channel 18. Such a decrease can be done by reducing the length of the barrier inlet channel 14 or by shortening the shelf length (the shelf is that distance from the edge of the ink feed channel 18 to the entrance to the barrier inlet channel), or a combination thereof.

On the other hand, the pillar 26 cannot be made too small, or it will not adhere to the substrate 12 throughout the usable life of the printhead.

The distance from the pillar 26 to the center of the resistor 16 is another factor that may be adjusted. In general, the longer that distance, the better, so as to allow flow from a larger area near the entrance to the barrier inlet channel 14, if a contamination particle is caught at the pillars, thus blocking ink flow from the ink feed channel 18, basically making the presence of pillars 26 transparent to resistor operation.

The pillars 26 are placed as close to the edge of the ink feed channel 18 as possible. In this way, it serves to screen particles, keeping them in the common area. Preferably, the pillars 26 are placed as close to the edge of the ink feed channel 18 as manufacturing tolerance will allow for the processing of substrate 12. Further, since the pillar 26 is the same height as the barrier layer 17, and is in fact formed during the definition of the barrier layer, it serves as a support pillar to prevent partial collapse of the nozzle plate 22 in the unsupported region, namely, at the edge of the ink feed channel 18. Such partial collapse in prior art pen designs has been responsible for pinching off ink flow over the life of the pen and causing dot placement errors.

For a pen operating at a given dot-per-inch (dpi) and having as its smallest dimension $x_{min}$, here, the diameter of orifice 20, the following relationships are obtained:

pillar spacing (ps)$\leqq x_{min}$;

pillar major axis diameter=$(dpi)^{-1}$−ps;

pillar minor axis diameter$\geqq y_{min}$, where $Y_{min}$ is the smallest dimension that would still provide good adhesion throughout the useful life of the pen. For example, present processing techniques require that $y_{min}$=50 μm. The length of the barrier inlet channel 14 is then reduced from the prior art design by an amount equivalent to about 10 to 20% of the value of $y_{min}$.

Using an elliptical cross-section permits narrower spacing between the pillars 21 to accommodate smaller orifi 20, yet allowing larger pillars without significantly increasing ink flow resistance.

Use of the reef configuration of the invention permits use of the present filter mesh. There is no need to change to a finer mesh filter.

The advantages of the invention are:

1. No additional processing step is needed.
2. The pillar gap can be adjusted to achieve the best contamination control for each ink-jet printhead design.
3. The pillar design can be modified by using different geometry to optimize adhesion to substrate.
4. The pillar design can be modified to provide fluid damping and refill control in addition to functioning as internal particle contamination control.
5. The pillars can act as support pillars between the substrate and the orifice plate for manufacturing and during operation.
6. Increased adhesion of the orifice plate for the life of the pen.

INDUSTRIAL APPLICABILITY

The use of a plurality of pillars in thermal ink-jet printheads is expected to find use in pens capable of operating at high frequencies and smaller nozzles.

What is claimed is:

1. A top-shooter ink-jet printhead in an ink-jet pen including:

(a) a plurality of ink-propelling elements, each ink-propelling element comprising a resistor element formed on a top surface of a substrate and disposed in a separate drop ejection chamber defined by three barrier walls formed in a barrier layer on said top surface of said substrate and a fourth side open to a reservoir of ink common to at least some of said ink-propelling elements and defining a barrier inlet channel, said barrier inlet channel having opposing side walls for directing ink from said reservoir to an associated drop ejection chamber;

(b) a plurality of nozzles comprising orifices disposed in a cover plate near said ink-propelling elements, each orifice operatively associated with a resistor element for ejecting a quantity of ink normal to the plane defined by each said element and through said orifices toward a print medium in defined patterns to form alphanumeric characters and graphics thereon;

(c) a common ink feed channel fluidically connected to said reservoir of ink beneath said substrate to accept a flow of ink therefrom and fluidically connected to said barrier inlet channel, said ink feed channel defining an edge on said top surface of said substrate, wherein ink is supplied to each of said ink-propelling elements from said common ink feed channel through said barrier inlet channel, the distance from said ink feed channel to the entrance of each said barrier inlet channel defining a shelf length of said printhead; and (d) a plurality of pillars, each pillar associated with an ink-propelling element and positioned along said edge of said ink feed channel opposite said entrance to said barrier inlet channel so as not to be located within any portion of said barrier inlet channel, said plurality of pillars serving to prevent particle contamination of said drop ejection chamber and to support said cover plate, each of said pillars being formed along with said barrier layer and being formed of the same material used to form said barrier layer so that said pillars are the same height as said barrier layer, a gap between adjacent pillars providing filtering of particles having a dimension greater than a width of said gap.

2. The top-shooter ink-jet printhead of claim 1 wherein each pillar is separated by a distance that is no greater than the smaller of the following dimensions: the diameter of said orifices and the width of said barrier inlet channels.

3. The top-shooter ink-jet printhead of claim 1 wherein each pillar is associated with the entrance to each said barrier inlet channel.

4. The top-shooter ink-jet printhead of claim 3 wherein each resistor and each pillar has a centerline such that said centerline of said pillar aligns with said centerline of said resistor associated therewith.

5. The top-shooter ink-jet printhead of claim 1 wherein each said resistor comprises a planar area, with said droplets of ink fired normal to said planar area through said orifi.

6. The top-shooter ink-jet printhead of claim 1 wherein each said pillar has an elliptical cross-section, with the major axis of the elliptical pillar perpendicular to ink flow from said common ink feed channel to said ink-propelling elements.

7. The top-shooter ink-jet printhead of claim 6 wherein the diameter of said major axis is given by the equation $(\text{dpi})^{-1}$-pillar spacing, where dpi is the number of dots per inch printable by said printhead and where pillar spacing is the distance between said pillars, and wherein the diameter of the minor axis of the elliptical pillar is at least that dimension that would provide good adhesion of said pillar to said substrate throughout the useful life of said pen.

8. A top-shooter ink-jet printhead in an ink-jet pen including:

(a) a plurality of ejection orifi for ejecting ink, each said ejection orifi including an ink-propelling element comprising a resistor element and a nozzle associated therewith;

(b) discrete ink passage communicating with respective ejection orifi, said ink passage being formed in a barrier layer of a first height, said ink passage having opposing side walls;

(c) an ink feed channel communicating with said discrete ink passages for supplying ink thereto;

(d) an ink reservoir for supplying said ink to said ink feed channel; and (e) a filter, comprising a plurality of pillars located between said ink feed channel and said discrete ink passages so as not to be located within any portion of said ink passages, said filter also serving to prevent collapse of said ink feed channel and said discrete ink passages, each of said pillars being formed along with said barrier layer and being formed of the same material used to form said barrier layer so that said pillars are the same height as said barrier layer, a gap between adjacent pillars providing filtering of particles having a dimension greater than a width of said gap.

9. The top-shooter ink-jet printhead of claim 8 wherein each pillar is separated by a distance that is no greater than the smaller of the following dimensions: the diameter of said orifices and the width of said discrete ink passages.

10. The top-shooter ink-jet printhead of claim 8 wherein each said ink-propelling element and each said discrete ink passage are formed in a barrier material comprising a photopolymerizable material having a pre-selected height and wherein each said pillar is the same height as said barrier layer.

11. The top-shooter ink-jet printhead of claim 8 wherein each pillar is associated with the entrance to each said discrete ink passage.

12. The top-shooter ink-jet printhead of claim 11 wherein each resistor and each pillar has a centerline such that said centerline of said pillar aligns with said centerline of said resistor associated therewith.

13. The top-shooter ink-jet printhead of claim 8 wherein each said resistor element comprises a planar area, with said droplets of ink fired normal to said planar area through said orifi.

14. The top-shooter ink-jet printhead of claim 8 wherein each said pillar has an elliptical cross-section, with the major axis of the elliptical pillar perpendicular to ink flow from said common ink feed channel to said ink-propelling elements.

15. The top-shooter ink-jet printhead of claim 14 wherein the diameter of said major axis is given by the equation $(dpi)^{-1}$-pillar spacing, where dpi is the number of dots per inch printable by said printhead and where pillar spacing is the distance between said pillars, and wherein the diameter of the minor axis of the elliptical pillar is at least that dimension that would provide good adhesion of said pillar to said substrate throughout the useful life of said pen.

* * * * *